United States Patent [19]

Nigro

[11] 4,003,529

[45] Jan. 18, 1977

[54] REEL AND BLANK THEREFOR

[75] Inventor: Paul R. Nigro, Chicago, Ill.

[73] Assignee: Royal Continental Box Company, Cicero, Ill.

[22] Filed: Apr. 4, 1975

[21] Appl. No.: 565,218

[52] U.S. Cl. ..... 242/118.8; 242/71.8

[51] Int. Cl.[2] ..... B65H 75/14

[58] Field of Search ..... 242/118.8, 118.7, 115–116, 242/71.8, 71.8 A

[56] References Cited

UNITED STATES PATENTS

| | | | |
|---|---|---|---|
| 2,339,311 | 1/1944 | Young | 242/118.8 X |
| 2,992,791 | 7/1961 | Johnson | 242/118.8 |
| 3,221,612 | 12/1965 | Webb | 242/118.8 X |
| 3,284,022 | 11/1966 | Elfrid | 242/118.8 |
| 3,329,259 | 7/1967 | Mayer | 242/118.8 X |

*Primary Examiner*—Edward J. McCarthy
*Attorney, Agent, or Firm*—Dressler, Goldsmith, Clement, Gordon & Shore, Ltd.

[57] ABSTRACT

A reel assembled from a pair of generally planar blanks and the blanks for assembling such reels, each of the blanks having a plurality of co-planar core members at least partially severed from the blank at radially offset circumferentially spaced locations. One or more of the core members may be displaced and axially offset to a core forming position along the axis of the blank, the exposed surfaces of the core thus formed from each blank may be abutted and suitably secured to form the reel in which the ends are defined by the blanks, and the thickness of the core is determined by the number of core members utilized to form the core.

33 Claims, 12 Drawing Figures

REEL AND BLANK THEREFOR

BACKGROUND OF THE INVENTION

The present invention relates to reels, i.e. devices typically having a generally cylindrical core and a head at each end of the core, and more particularly to such reels assembled from generally planar blanks and to the blanks for producing such reels.

Reels have a wide variety of applications and uses involving winding up or paying out flexible materials. Often, such materials are wound on reels directly from or as a part of manufacturing operations. When reels are utilized, it is, of course, necessary to have them available. This often creates storage problems involving substantial space requirements.

While there may be no alternative in some instances, in many cases, the availability of a structure which could minimize space requirements and reduce shipping and storage costs would be, to say the least, attractive. Such possibilities arise, for example, when the axial dimension of the reel is not too great, and when the diameter of the reel core may be less than twice the diameter of the reel heads. Furthermore, such reels can in many instances be produced from materials such as, e.g., paper board, corrugated board and the like, which is relatively inexpensive and may be disposable after use, although advantages from such structures are not necessarily limited to these materials.

SUMMARY OF THE INVENTION

In accordance with the present invention there is provided a reel assembled from a pair of generally planar blanks, as well as the blanks from which the reels can be assembled.

A reel incorporating the present invention is assembled from a pair of blanks, each having a plurality of co-planar core members at least partially severed therefrom at radially offset circumferentially spaced locations. One or more of these core members may be displaced and axially offset to a core forming position along the axis of the blank and may be suitably secured in that position. The exposed faces of the core thus formed from each blank may be abutted and suitably secured together to form the reel in which the heads are defined by the blanks, and the space between the heads, i.e., the thickness of the core, is determined by the number of core members utilized to form the core.

Blanks in accordance with the present invention may be shipped and stored as such prior to their use in assembling the reel, thus providing savings in shipping and storage space. The reels may be assembled easily and quickly, and the axial spacing between the reel heads may be selectively determined during assembly in accordance with the intended use of the assembled reel.

Depending on the intended use and the material with which the reel is to be used, it may be made out of any suitable material such as wood, paper board, corrugated board and the like.

When the blanks are made out of materials such as corrugated board, the core members may be foldably connected to the blank by hinge tabs formed integrally therewith to permit folding of the core members from their respective co-planar locations to the desired axial core forming position. The core forming members may be suitably retained in place such as by use of an appropriate adhesive.

If the blanks are formed from materials substantially thicker than the usual corrugated board, e.g., wood, the core members may be completely severed from the blank and connected thereto by suitable separate hinge members. The hinge members are preferably of differing lengths, or may be adjustable in length, to accomodate the different axial offset which occurs when successive core members are folded in the axial core forming position one on top of the other. The length of the hinge may also define a predetermined sequence or order in which the core members should be folded into their axial core forming position.

While the core members are typically circular, since the usual core is cylindrical, the core members may have various other shapes, and alternative configurations may be utilized to permit the formation of cores having thicknesses greater than the combined thickness of the core members utilized, the thickness of each core being determined by the thickness of the blank from which they are severed.

Numerous other advantages and features of the present invention will become readily apparent from the following detailed description of the invention and of one embodiment thereof, from the claims and from the accompanying drawing in which each and every detail shown is fully and completely disclosed as a part of this specification in which like numerals refer to like parts.

DESCRIPTION OF PREFERRED EMBODIMENTS

Figure 1:
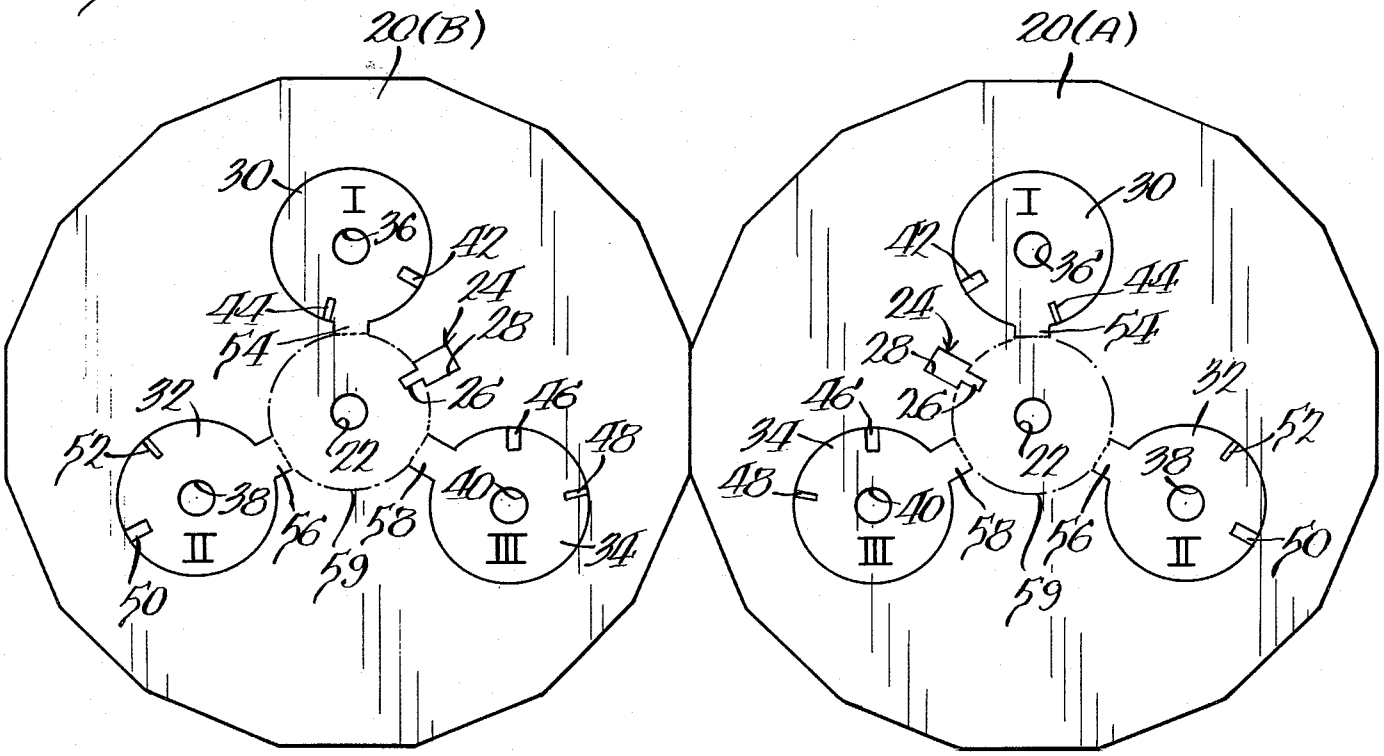
FIG. 1 is a plan view of a pair of reel blanks incorporating the present invention.

While this invention is susceptible of embodiment in many different forms, there is shown in the drawings and will herein be described in detail a preferred embodiment of the invention and modifications thereof, with the understanding that the present disclosure is to be considered as an exemplification of the principles of the invention and is not intended to limit the invention to the embodiments illustrated. The scope of the invention will be pointed out in the appended claims.

FIG. 1 is a plan view of a pair of generally circular blanks 20 from which a reel may be readily assembled. Although the blanks 20 are shown in FIG. 1 as mirror images of each other, and are identified as 20 (A) and 20 (B), they are otherwise identical. For convenience, therefore, only one blank is described below, and like numerals are used to refer to corresponding parts of each blank.

Each of the blanks 20 may be constructed of a suitable material such as, for example, corrugated paper board, stiff card board or possibly even a suitable plastic, and includes an axial hole or aperture 22 for a pin or spindle (not shown). The blank 20 also includes a key slot 24 composed of a pair of generally rectangular interconnected slots, a narrow slot 26 disposed radially inwardly of a wider slot 28 which may be utilized as drive or starting slot in the assembled reel.

In the embodiment shown in FIGS. 1–6, each blank includes three generally circular core members 30, 32 and 34, partially severed from the blank 20 at radially offset, circumferentially spaced locations. The core members 30, 32, 34 are each provided with a central aperture 36, 38, 40, respectively, which are substantially identical in size to the axial aperture 22. Each of the core members 30, 32, 34 also includes a pair of peripheral notches 42, 44, 46, 48, 50, 52 disposed about the periphery of each core so the notches are aligned with each other when the core members are folded into the core forming position as described in more detail below. Furthermore, the notches 42, 46, 50 also are aligned with the key slot 24.

Each of the core members 30, 32, 34 is foldably connected to the blank 20 by a hinge tab 54, 56, 58, respectively. Each of the hinge tabs 54, 56, 58 are severed from the blank 20 along their side edges, while the inner and outer edges of the hinge tabs are scored to foldably connect the radially outer edge of each hinge tab 54, 56, 58 to the periphery of a corresponding core member 30, 32, 34, respectively, and the radially inner edge of each hinge tab to the reel blank 20.

The scored inner edges of the hinge tabs 54, 56, 58 are radially offset from the axis of the blank 20 an equal distance, i.e., are disposed along the periphery of a circle 59 of constant diameter, the diameter of which is equal to diameter of each of the core members 30, 32, 34. Each of the hinge tabs has a different radial dimension or length, hinge tab 54 being the shortest and hinge tab 58 being the longest. As a result, the axis of each core member, as shown in FIG. 1, is radially offset from the axis of the blank a distance which differs by an amount equal to the differences in the length of the various hinge tabs.

Figure 6:
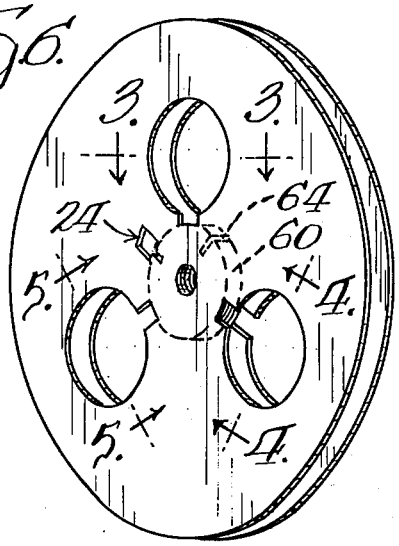
FIG. 6 is a perspective view of one embodiment of a reel assembled from the blanks of FIGS. 1 and 2.
Figure 2:
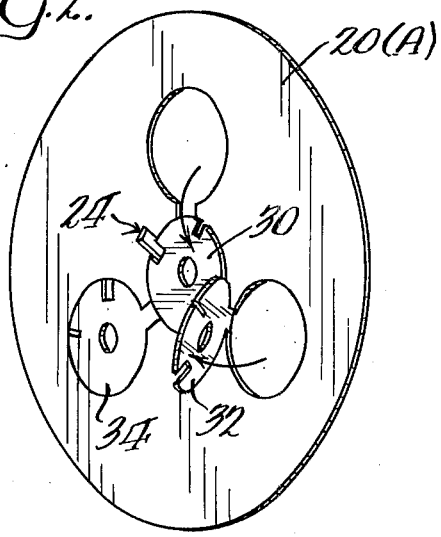
FIG. 2 is a perspective view of one blank showing how the core members may be folded into the core forming position.
Figure 3:
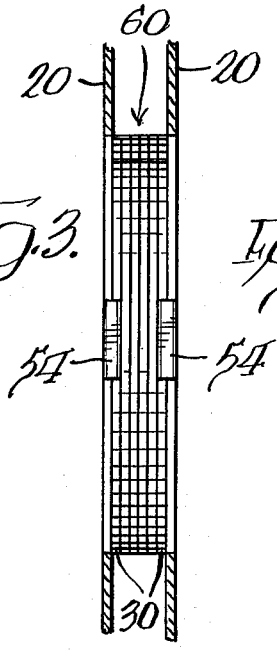
FIG. 3 is an enlarged sectional view taken along lines 3—3 of FIG. 6.

Each core member 30, 32, 34 may be folded about its respective hinge tab 54, 56, 58 to an axial core forming position to form the core 60 as is best shown in FIGS. 2 and 6. The core members are folded into the core forming position in a preselected sequence (indicated by the Roman numerals "I," "II" and "III" in FIG. 1) as determined by the length of each hinge tab. This is best seen in FIGS. 4, 5 and 6 which show a core formed by six core members, three from each blank 20.

Figure 4:
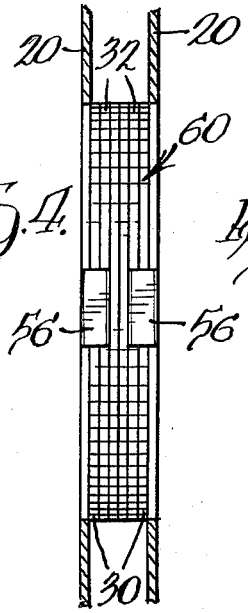
FIG. 4 is an enlarged sectional view taken along lines 4—4 of FIG. 6.
Figure 5:
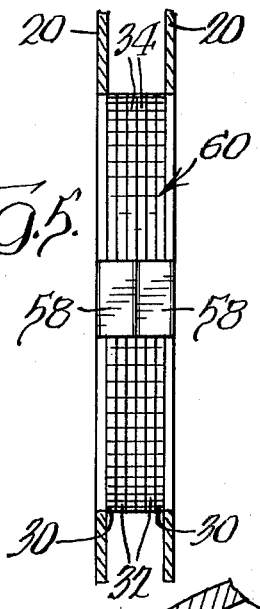
FIG. 5 is an enlarged sectional view taken along lines 5—5 of FIG. 6.

As seen in FIG. 4, the first core member 30 to be folded into the core forming position is connected to the blank by the shortest of the hinge tabs 54 which has a radial dimension equal to approximately twice the thickness of the blank 20 because in its core forming position, the hinge tab traverses the blank 20 and the folded core member 30.

The second core member 32 is connected to the blank 20 by the hinge tab 56 having a length substantially equal to three times the thickness of the blank 20 since, as shown in FIG. 4, when core member 32 is in the axial core forming position the hinge tab 56 traverses the blank 20 and the core members 30 and 32. A third core member 34 is connected to the blank 20 by hinge tab 58 having a length approximately equal to four times the thickness of the blank 20 since it traverses the blank and all three of the core members, as seen in FIG. 5.

In the reel produced from the blank, shown in FIG. 6, the holes left by the folded core members are aligned with each other since, as indicated above, the blanks are mirror images of each other. It should be understood, however, that this arrangement, although preferred, is not necessary and that the circumferential position of the respective core members may vary as desired.

Figure 7:
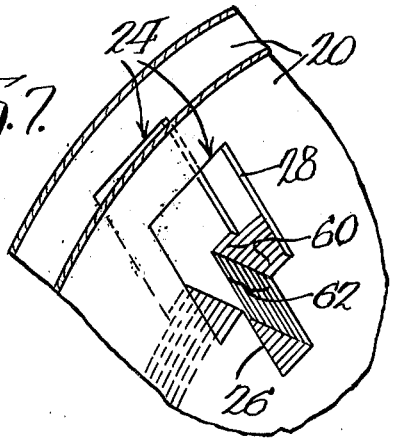
FIG. 7 is an enlarged partial perspective view showing the key slot of an assembled reel.

It is apparent, however, that when the key slot 24 is utilized, that it must be positioned between adjacent core members and it is probably preferable to space it midway therebetween. As seen in FIG. 7, the narrow portion 26 of the key slot 24 extends inwardly of the diameter of the core 60, and the peripheral notches 42, 46, 50 in each core member are aligned with each other to form slot 62 in the core 60 which, in turn, is aligned with the narrow portion 26 of the key slot 24. The other peripheral notch 44, 48, 52 in each of the core members are also aligned with each other when the core 60 is formed and may be used, for example, as a starting slot 64 for the material to be wound on the reel.

Figure 8:
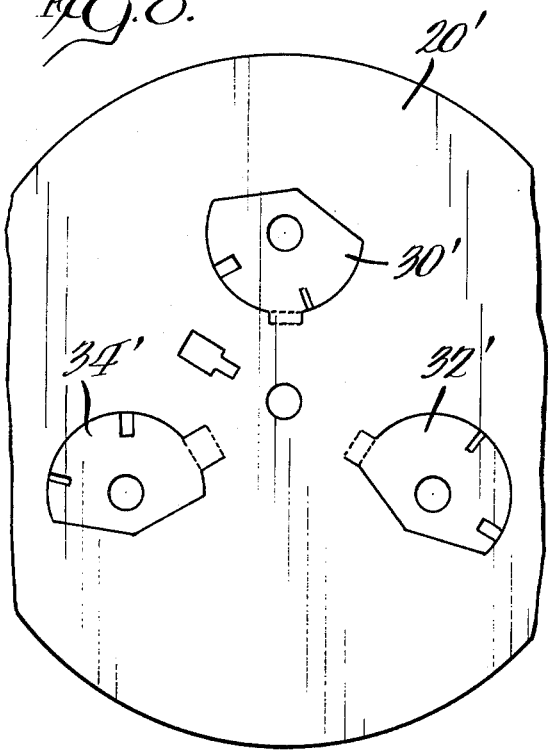
FIG. 8 is a partial plan view of a reel blank showing an alternative form of core members.

FIG. 8 is an alternative embodiment in which the generally circular core members 30, 32, 34 of FIGS. 1–6 have been modified, i.e., in which portions of the otherwise circular core members 30′, 32′, 34′ have been truncated. Such a configuration may be desirable when it is desirable to minimize the amount of material severed from the blank. Since the truncated portions of the core members will not be aligned, the over all periphery of the core remains generally circular.

Figure 9:
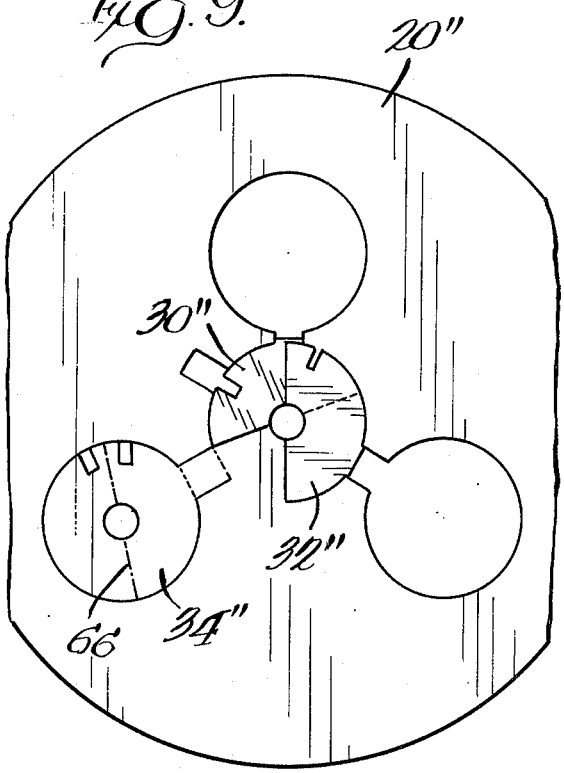
FIG. 9 is a partial plan view of a reel blank showing another alternative embodiment of core members.
Figure 10:
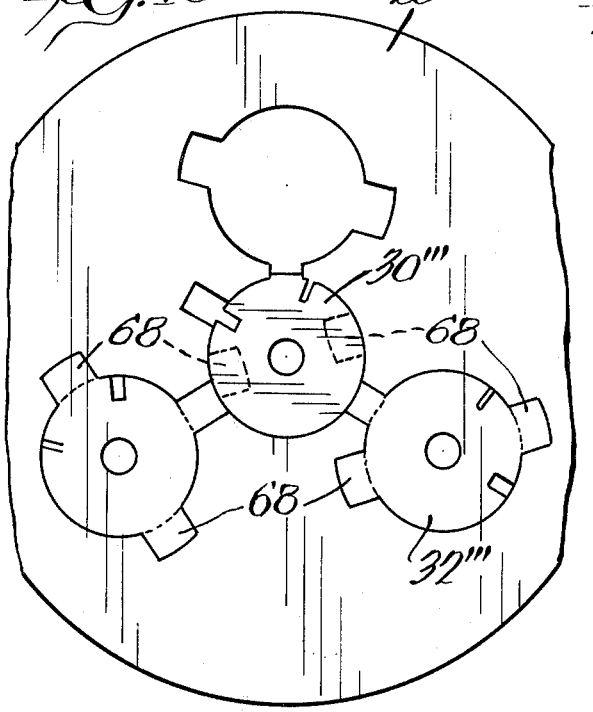
FIG. 10 is a partial plan view of a reel blank showing yet another alternative embodiment of core members.

FIGS. 9 and 10 show alternative embodiments for increasing the axial dimension of the core. In FIG. 9, each core member 30″, 32″, 33″ is diametrically scored at 66 so that it may be folded onto itself before being folded into its core forming position.

In FIG. 10, each core member 30‴, 32‴, 34‴ is provided with radially extending tabs 68 which may be folded under and against the surface of each core member to increase the effective thickness of the core member when it is folded into its axial core forming position.

Figure 11:
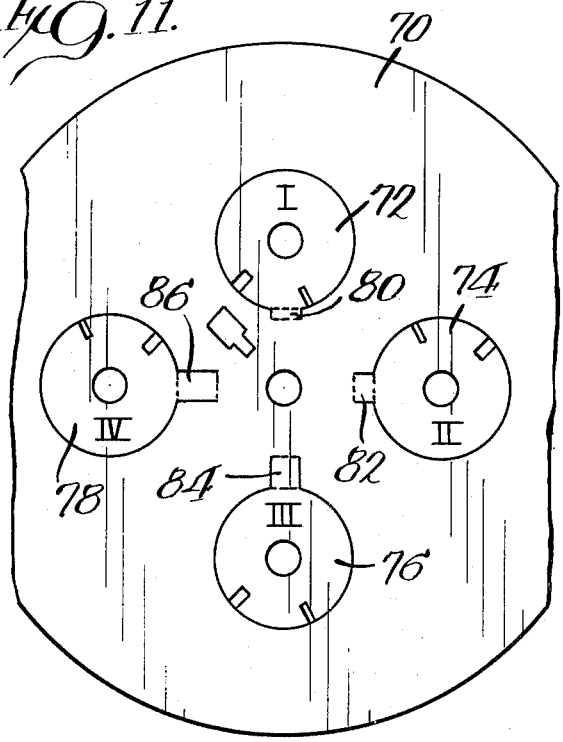
FIG. 11 is a partial plan view of a further alternative embodiment of a reel blank.

It should be understood, that blanks in accordance with the present invention are not limited to three core members and more or less may be utilized as seen in FIG. 11. The reel blank 70 in FIG. 11 incorporates four core members 72, 74, 76, 78, each connected to the blank 70 by hinge tabs 80, 82, 84, 86, respectively. The core members 72, 74, 76, 78 are folded into their axial position in a preselected sequence (indicated by Roman numerals I, II, III and IV) determined by the radial dimensions of the corresponding hinge tabs.

In the embodiments of FIGS. 1–11, the core members are connected to the blank by integral hinge tabs. This construction is particularly suitable when the blanks are formed from materials such as corrugated board which may have thickness of up to about one-half inch.

Figure 12:
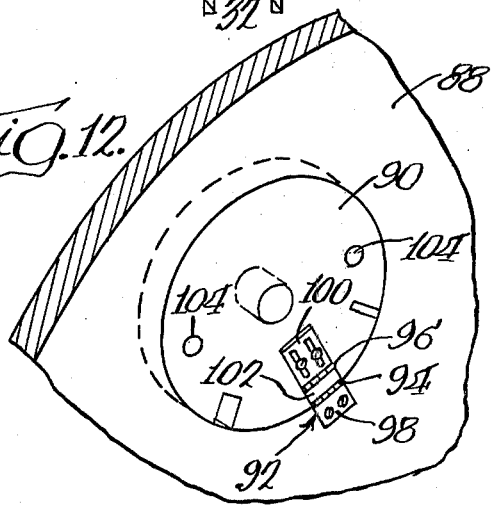
FIG. 12 is a partial perspective view of another alternative embodiment of a reel blank.

When as seen in FIG. 12 the blank 88 is thicker or when it is made of other materials such as wood, the core members (only core member 90 being illustrated) may be completely severed from the blank 88 and connected thereto by separate hinges 92. The hinge 92 is designed to accommodate the axial offset position that the core member 90 assumes when folded into the core forming position. One example of such a hinge shown in FIG. 12 is a three piece hinge having a pair of hinge connections 94, 96. One end 98 of the hinge 92 is secured to the blank 88; the other end 100 is slidably secured to the core member 90. The length of the center section 102 of hinge 92 is determined by the axial offset of the core member in its core forming position.

Blanks so constructed might very well be reusable in which case, the reel may be assembled by passing bolts or other mechanical fasteners (not shown) through holes 104 formed in the blank 88 and in the core member 90.

Thus there has been disclosed in accordance with the present invention a reel readily assembled by the user from generally planar reel blanks having at least partially severed therefrom a plurality of core members one or more of which may be displaced or folded into an axial core forming position and there secured, by the use of a suitable adhesive or mechanical device. The blanks incorporating the present invention until utilized are amenable to compact storage since they are substantially planar and assembly of the reel from the blanks of the present invention may be accomplished rapidly, easily and often without the use of any implements or tools. The blanks themselves are adaptable to have appropriate printing on the outer surfaces thereof for advertising purposes or for product identification.

From the foregoing, it will be observed that numerous variations and modifications may be effected without departing from the true spirit and scope of the novel concept of the invention. It is, of course, intended to cover by the appended claims all such modifications as fall within the scope of the claims.

What is claimed is:

1. A reel of the type having a generally cylindrical core and a head at each end thereof and assembled from a pair of generally planar blanks:

said blanks defining said reel heads; and a core disposed between said heads along the axis of said reel;

said core formed by at least one core member at least partially severed from one of said blanks at a location radially offset from the axis thereof and displaced from its offset location to its axial core forming position.

2. A reel as claimed in claim 1 wherein:

each of said planar blanks includes a key slot radially offset from the axis thereof said slots being radially and circumferentially aligned with each other.

3. A reel as claimed in claim 2 wherein:

said displaced core member includes a peripheral notch circumferentially aligned with said key slots.

4. A reel as claimed in claim 3 wherein:

said peripheral notch is radially aligned with at least a portion of said key slots.

5. A reel as claimed in claim 1 wherein:

each of said blanks defines an aperture extending therethrough along the axis thereof; and said displaced core member has a central aperture passing therethrough aligned with said axial apertures in said blanks.

6. A reel as claimed in claim 1 including:

hinge means foldably interconnecting said core member and said one blank, whereby said core member is folded into its core forming position.

7. A reel as claimed in claim 1 wherein:

said core member is partially severed from said one blank and is folded from its offset location to its axial core forming position.

8. A reel as claimed in claim 7 including:

hinge means partially severed from said one blank and formed integrally with and foldably interconnecting said core member and said one blank.

9. A reel as claimed in claim 1 including:

a plurality of said core members severed from said one blank at circumferentially spaced locations radially offset from the axis thereof;

said core being formed by selected ones of said core members displaced from their respective offset locations to said axial core forming position, whereby said core has an axial dimension determined by the number of core members forming said core.

10. A reel as claimed in claim 9 including:

a plurality of hinge means each foldably interconnecting one of said core members and said one blank;

whereby said core is formed by selected core members folded into said core forming position.

11. A reel as claimed in claim 10 wherein:

said hinge means are longitudinally adjustable to accomodate various possible axial positions of the core member connected thereto in the core forming position.

12. A reel as claimed in claim 1 including:

a plurality of said core members partially severed from said one blank at circumferentially spaced locations radially offset from the axis thereof;

said core being formed by selected ones of said core members folded from their respective said offset locations to said axial core forming position, whereby said core has an axial dimension determined by the number of core members forming said core.

13. A reel as claimed in claim 12 including:

a plurality of hinge means partially severed from said blank, each formed integrally with and foldably interconnecting one of said core members and said blank.

14. A reel as claimed in claim 13 wherein:

each of said hinge means is formed as a hinge tab having its sides severed from said blank and having its radially inward and outward edges scored to define the foldable connections between said hinge tab on the one hand and said blank and said one core member on the other.

15. A reel as claimed in claim 14 wherein:

each hinge tab connecting a core forming core member to said blank lies in a plane generally perpendicular to the plane of said blank.

16. A reel as claimed in claim 15 wherein:

each hinge tab connecting a core forming core member to said blank extends along the periphery of said core.

17. A reel as claimed in claim 14 wherein:

each of said hinge tabs has a different length for defining the axial displacement of the core member to which it is connected when in the core forming position.

18. A reel as claimed in claim 17 wherein:

the length of each of said hinge tabs is generally an integral multiple of the thickness of said blank.

19. A reel as claimed in claim 18 wherein the length of the smallest of said hinge tabs is generally equal to twice the thickness of said blank.

20. A reel as claimed in claim 18 in which the length of each of said hinge tabs is equal to $(n + 2)$ times the thickness of said blank where $n$ equals the number of core members forming said core and disposed between the core member to which said hinge tab is connected and said blank.

21. A reel as claimed in claim 1 wherein:

the periphery of each of said blanks is generally circular.

22. A reel as claimed in claim 21 wherein:

the periphery of each of said blanks is a regular polygon.

23. A reel as claimed in claim 22 wherein:

the periphery of each of said blanks is a regular polygon having at least 16 sides.

24. A generally planar blank for use in producing a reel having an axial core and a head at each end thereof;

said blank having a generally circular periphery and an axis extending generally perpendicular to the surface thereof; and a plurality of co-planar core members at least partially severed from said blank at radially offset circumferentially spaced locations;

each of said core members being selectively displacable from its original co-planar location to an axially aligned and axially offset position for forming at least a portion of said axial core.

25. A generally planar blank as claimed in claim 24 wherein:

the axial offset of each of said core members when displaced to said core forming position is different.

26. A pair of generally planar blanks as claimed in claim 24 wherein:

the exposed surface of each of the displaced core members of each blank having the maximum axial displacement are adapted to be abutted in surface to surface contact to form a reel having an axial core defined by said displaced core members and a head at each end of said core formed by said planar blanks.

27. A generally planar blank as claimed in claim 24 including:

hinge means partially severed from said blank and formed integrally with and foldably interconnecting each of said core members and said blank;

whereby each of said core members displaced to said core forming position are folded through an angle of approximately 180°.

28. A generally planar blank as claimed in claim 27 wherein:

each of said hinge means is formed as a hinge tab having its sides severed from said blank and having its radially inward and outward edges scored to define said foldable connections between said hinge tab on the one hand and said blank and one of said core members on the other.

29. A generally planar blank as claimed in claim 28 wherein:

each of said hinge tabs has a different length.

30. A generally planar blank as claimed in claim 29 wherein:

said core members are generally circular in plan view and having substantially identical diameters; and the scored inner edge of said hinge tabs lies along the periphery of a circle the center of which coincides with the axis of said blank and the diameter of which is substantially equal to the diameter of said core members;

whereby the radial offset of said core members in their original coplanar locations differ by an amount generally equal to the difference in the lengths of said hinge tabs.

31. A generally planar blank as claimed in claim 29 in which the radial dimension of said hinge tab defines the desired axial offset of the core member when folded into said core forming position and, thereby the sequence in which said core members are folded into said core forming position.

32. A generally planar blank as claimed in claim 30 wherein:

each of said generally circular core members is scored along the diameter thereof to permit folding thereof into a semi-circle, for increasing the axial dimension of the core formed by said folded core members.

33. A generally planar blank as claimed in claim 30 wherein:

each of said generally circular core members includes a plurality of radial tabs extending from the periphery thereof, each of said tabs being foldable against the surface of the core member for increasing the axial dimension of the core formed by said folded core members.

* * * * *